US006015217A

United States Patent [19]

Colangelo et al.

[11] Patent Number: 6,015,217

[45] Date of Patent: Jan. 18, 2000

[54] UNIFORM EPAULET-COUPLED EMERGENCY FLASHLIGHT

[76] Inventors: David W. Colangelo, 5 Tracy Pl.; Robert D. Burns, 225 Azalea Cir., both of Jackson, N.J. 08527

[21] Appl. No.: 09/241,917

[22] Filed: Feb. 2, 1999

[51] Int. Cl.[7] ..... F21L 15/08

[52] U.S. Cl. ..... 362/103; 362/184; 362/191; 362/197; 362/208; 362/802

[58] Field of Search ..... 362/103, 108, 362/191, 190, 253, 183, 184, 200, 197, 208, 802

[56] References Cited

U.S. PATENT DOCUMENTS

| | | | |
|---|---|---|---|
| 2,506,685 | 5/1950 | Sadloski et al. | 362/108 |
| 3,083,295 | 3/1963 | Baker | 362/108 |
| 4,517,627 | 5/1985 | Bradford | 362/191 X |

*Primary Examiner*—Stephen Husar
*Attorney, Agent, or Firm*—Charles I. Brodsky

[57] ABSTRACT

A flashlight in a housing of given size dimension to fit within and under a shoulder epaulet on an article of clothing worn as part of a uniform by a person engaged in law enforcement or emergency medical service activity, for example, with a fastener at a top surface of the housing in the nature of a clip or otherwise, so as to secure to the shoulder epaulet in providing hands-free operation, and preferably generating its light beam through a rotatable front end of the flashlight which both adjusts the angle of the beam, and which acts as the on-off switch for the flashlight. In a second embodiment of the invention, a flashing light beam could also be provided to illuminate through a back end of the flashlight, in giving a stroboscopic type of warning light to oncoming vehicular traffic to reduce speed in nearing the scene being approached.

13 Claims, 3 Drawing Sheets

UNIFORM EPAULET-COUPLED EMERGENCY FLASHLIGHT

FIELD OF THE INVENTION

This invention relates to the field of law enforcement and, more particularly, to the safety protection of those charged with the responsibility of enforcing the laws of this country both in a civilian and/or military environment.

BACKGROUND OF THE INVENTION

As is well known and understood, such law enforcement personnel as civilian and military police, corrections officers, border patrol, etc. usually carry on their person the typical "tools-of-the-trade"—namely, their weapon, their baton, their handcuffs, chemical sprays to subdue assailants, their note-pad, and other items needed for purposes of protection and/or for daily police use. One such item, however, which has been noted to create problems as well as being helpful, is the flashlight employed by many such enforcement personnel—typically being of some 5 pounds in weight, and some 18–24 inches long. In nighttime use, as an illustration, the police personnel are oftentimes called upon to review identification and/or other papers handed to them by a person being questioned, and in doing so, it is not unusual for the officer to hold the flashlight, then lit, under the arm, in the armpit, shining down on the papers the officer looks through. On several occasions, though, the person being questioned has responded by grabbing the flashlight from the armpit area where it was temporarily held, and attempted to use it as a weapon against the interrogating officer. With the officer holding the paperwork in his, or her, hands at such time, an immediate disadvantage to the questioning personnel results, and the officer is placed in serious harm's way.

Additionally, such nighttime use places the officer in jeopardy in yet another way. Frequently, for example, with this interrogation of paperwork taking place at a vehicular stop—even where the officer is holding the flashlight fast in hand—oncoming motorists notice the vehicles parked alongside the road, and become distracted away from the scene of the interrogation where both the officer and the other person, or persons, are standing. Instances have been well recorded of these oncoming vehicles running into the officer or the other people there.

In both these instances, it would be desirable to protect the officer who is only doing his, or her, job—from circumstances where the carrying out of their sworn responsibilities exposes them to the possibility of injury, if not death.

OBJECTS OF THE INVENTION

It is an object of the present invention, therefore, to provide a new and improved manner of using flashlight sources of illumination, at nighttime, by law enforcement personnel in questioning and/or interrogating persons—whether they be suspects or not—in both open and closed areas, indoors or at high traveled highway locations.

It is an object of the present invention, also, to provide such flashlight apparatus that can be easily operated by the officer, and in a hands-free manner.

It is an additional object of the invention to provide such flashlight apparatus which, even if able to be grabbed and used as a weapon by the person being interrogated, is of a small size and bulk so as not to be readily effective against the officer—whether he, or she, be on patrol outdoors, or in such a controlled, closed environment as a prison or jail facility.

It is a further object of the invention to provide such flashlight apparatus of a type able to provide an additional stroboscopic type of warning light to oncoming vehicular traffic which might be approaching from behind the police officer, so as to alert the motorist of an ongoing police activity.

It is yet another object of the invention to provide this flashlight apparatus which is easy to carry about, and unobtrusive in its appearance so as to not alert a potential assailant being questioned during daylight hours of its presence, and thereby reduce the possibility of the flashlight then being grabbed for use as a weapon against an interrogating officer.

SUMMARY OF THE INVENTION

As will become clear from the following description, a flashlight, according to the invention, is incorporated in a housing of given size dimension to fit within and under a shoulder epaulet of the type typically found on an article of clothing worn as part of a uniform by a person engaged in such law enforcement activity—typically, on a shirt or jacket. In accordance with the invention, for example, a fastener (in the nature of a clip or otherwise), is incorporated at a top surface of the housing to secure to the shoulder epaulet in providing hands-free operation. As will be seen, in a preferred embodiment of the invention, the flashlight is of the type to generate its light beam through a rotatable front end which both spreads the angle of the beam, and adjusts it upwards and downwards—and with the front end acting as the "on-off" switch for the flashlight itself. In this preferred embodiment, furthermore, in the quiescent "off" position, the front end of the flashlight will be seen to face inwardly, thereby hooding the bulb end, and concealing the nature of the housing as an illuminating source.

As will also become clear, a flashing light beam is additionally provided to illuminate through a back end of the flashlight, in affording a rearwardly projected beam to serve as a warning to oncoming motorists to reduce speed in nearing the scene being approached.

As described below, such a flashlight arrangement provides a steady light beam in use through the front end, and a flashing light beam through the back end—with both sources of light beam illumination being powered, by rechargeable Ni-cad, or AA or AAA alkaline, batteries included within the flashlight, appreciating that the use of the larger size C and D batteries are the ones which give rise to the large size and bulk characterizing the police flashlights in general use today—which offer the possibility of being turned into a weapon against the questioning officer. To accommodate the fitting within and under the shoulder epaulet, and in a snug manner, the flashlight housing according to the invention is selected of a width of the order of 1½ in. and of a thickness of the order of ¾ in.—although other widths and thicknesses may be selected instead, as long as the housing continues to snugly fit within the shoulder epaulet when the uniform shirt or jacket is worn. In either event, the fastener—be it clip or otherwise—continues on the housing to secure the flashlight to the shoulder epaulet.

BRIEF DESCRIPTION OF THE DRAWING

These and other features of the present invention will be more clearly understood from a consideration of the following description, taken in connection with the accompanying drawing, in which.

DETAILED DESCRIPTION OF THE INVENTION

Figure 1:
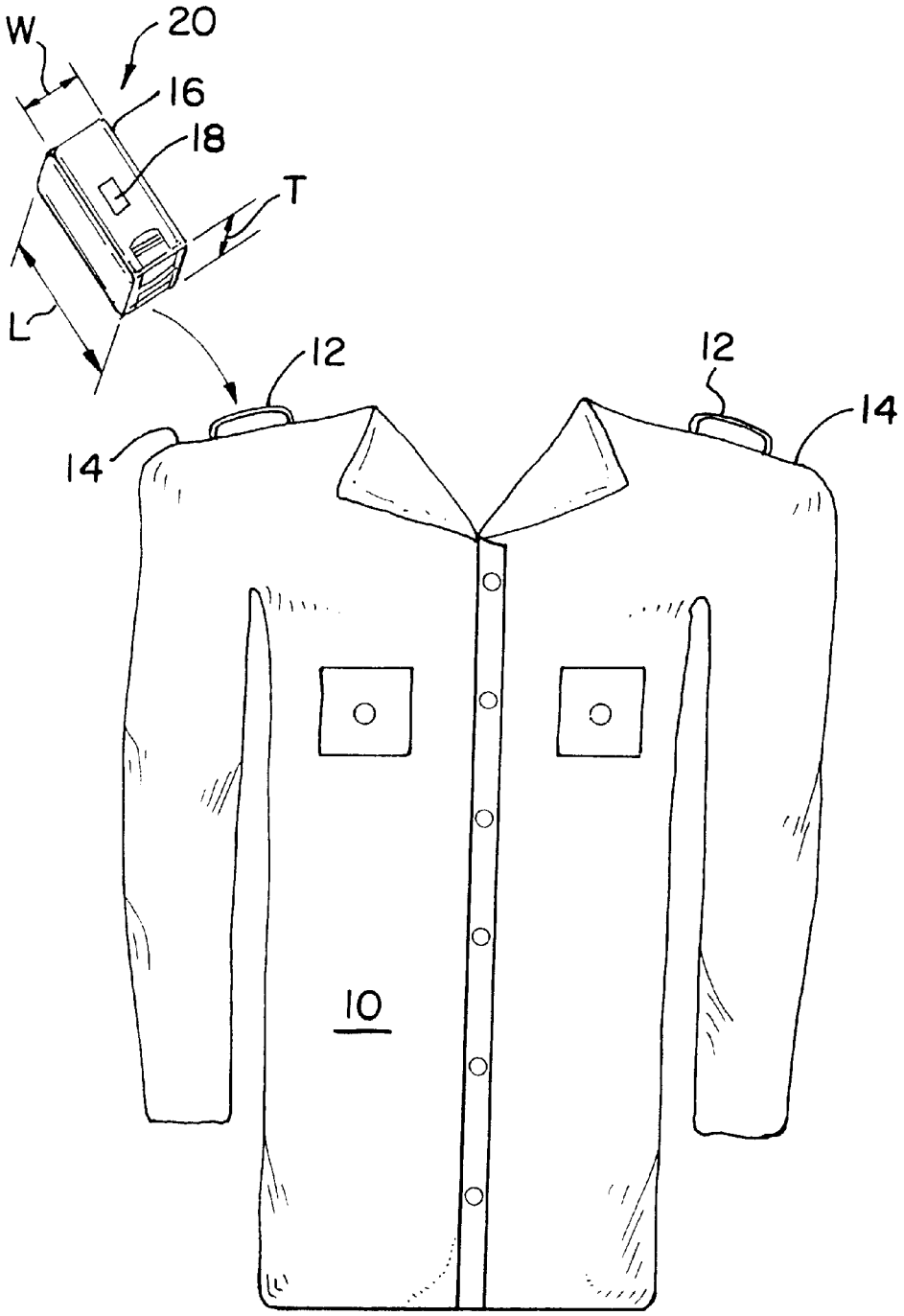
FIG. 1 illustrates a law enforcement uniform shirt or jacket having a shoulder epaulet of a configuration commonly employed, or fabricated as such for use in accordance with the teachings of the invention.

In FIG. 1, reference numeral 10 identifies a uniform shirt of the type worn by law enforcement personnel in the spring or summer, or a uniform jacket worn in the fall or winter, along with the shoulder epaulet 12 usually found at the shoulder 14—and if not so included, then to be added there in accordance with the teachings of the present invention. As also shown, a flashlight 20 in a housing 16 is intended for placement within and under the epaulet 12, with a fastener 18 at its top surface 20 to be secured to the epaulet when so inserted. Selected of dimension to fit within and under the epaulet 12 in a manner to be fastened to it as by a clip in a snug manner, such housing 16 may be of rectangular cross-section. In a preferred embodiment, the housing 16 may be of a width W of the order of 1½ in. and of a thickness T of the order of ¾ in. Such housing 16 may be fabricated of plastic, or any other appropriate material, and of a length L of the order of 3–4 in.

Figure 2A:
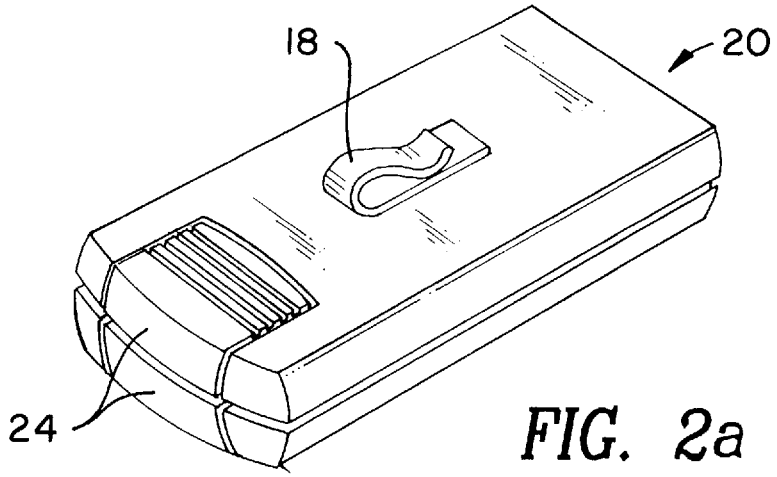
FIGS. 2*a*–2*c* are perspective views of a flashlight constructed in accordance with the invention, helpful in an understanding of the flashlight being turned "on" and "off", and in a manner to illuminate, amongst other things, papers held by a law enforcement officer in a "hands-free" manner of flashlight illumination.
Figure 2B:
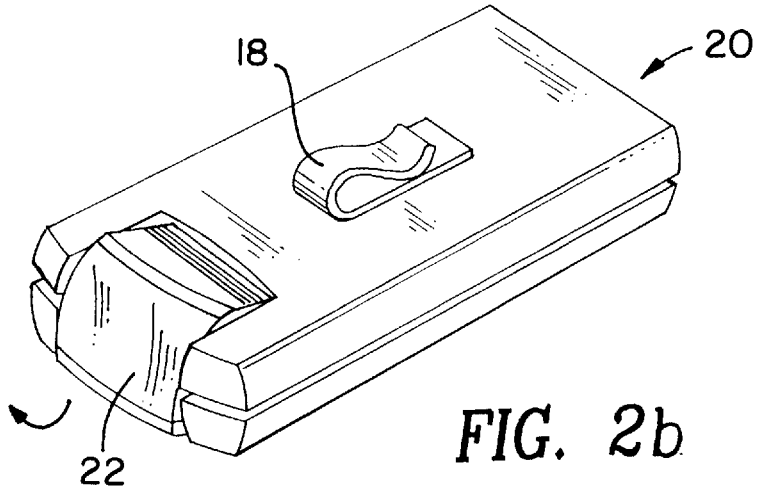
Figure 2C:
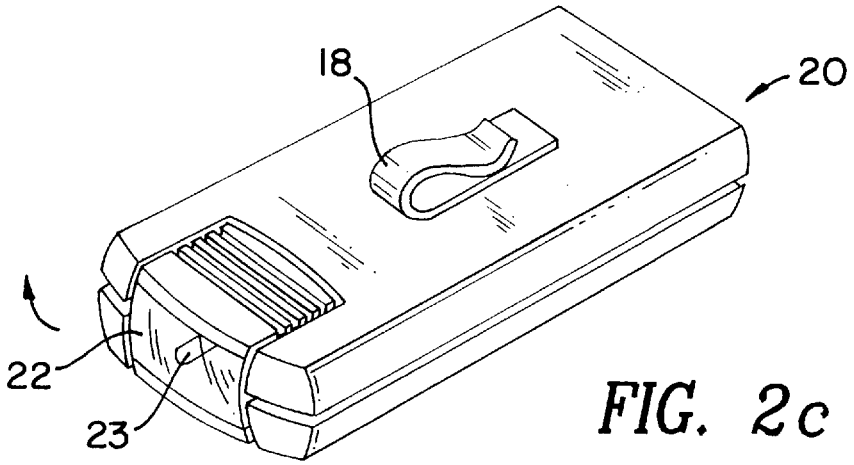

FIGS. 2*a*–2*c* respectively illustrate the flashlight 20 as it is being turned from its initial quiescent "off" position (FIG. 2*a*) to a detented, final "on" position (FIG. 2*c*). In its "on" position (FIG. 2*c*), the light beam generated by a candle bulb 23 (for example) is arranged to illuminate through a clear section of the front end 22, shown as being rounded, for spreading the light beam generated. FIG. 2*a*, on the other hand, illustrates, at 24, the front end 22 facing inwardly of the housing 16 when the front end 22 is in the initial quiescent "off" position, thereby hooding the bulb 23. Rotating the front end 22 upwards and downwards with respect to the quiescent position serves as the "on-off" switch for the flashlight 20 and serves to adjust the angle of the light beam generated. The rear section of the front end 22 is fabricated of the same material, and of the same coloration, as the housing 16, such that when the flashlight is "off", with the bulb 23 hooded (FIG. 2*a*), thefront end 22 and the housing 16 secured to the epaulet 12 by the fastener 18 take on the appearance of a small rectangular box. When it is desired to turn the flashlight "on", the front end 22 is merely rotated as a switch by the officer from the quiescent "off" position (FIG. 2*a*), to the intermediate position (FIG. 2*b*), and from there, to the detented, final "on" position of FIG. 2*c*, in progressing to the straight line position of FIG. 2*c*. At the in-between position of FIG. 2*b*, the flashlight 20 is "on", at the selected angle of adjustment.

Figure 3:
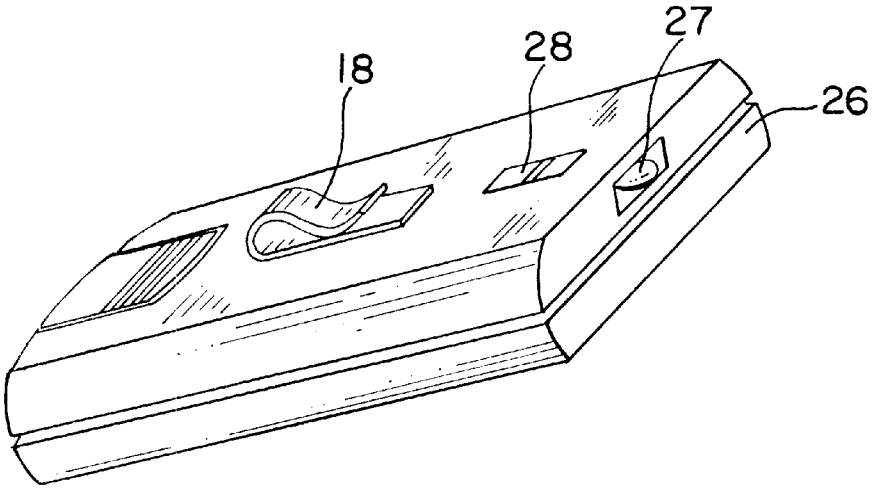
FIG. 3 is a further perspective view of the flashlight of FIGS. 2*a*–2*c*, helpful in an understanding of the providing of a stroboscopic warning light in a direction rearwardly of the flashlight when secured within and under the shoulder epaulet.

FIG. 3 illustrates the back end 26 of the housing 16, in providing a flashing or stroboscopic light beam rearwardly of the law enforcement officer involved in a questioning at an activity scene. Such light may be generated by a halogen bulb 27—also powerable from rechargeable or alkaline batteries—and of a type to be visible for a distance from several hundred feet up to ½–1 mile. A separate "on-off" switch for this rearward illumination is shown at 28. As will be appreciated, such separate switch 28 should be at a location on the housing 16 reachable by the officer in deciding to generate the rearward illumination, if not automatically activated by the rotation of the front-end switch 22.

Figure 4:
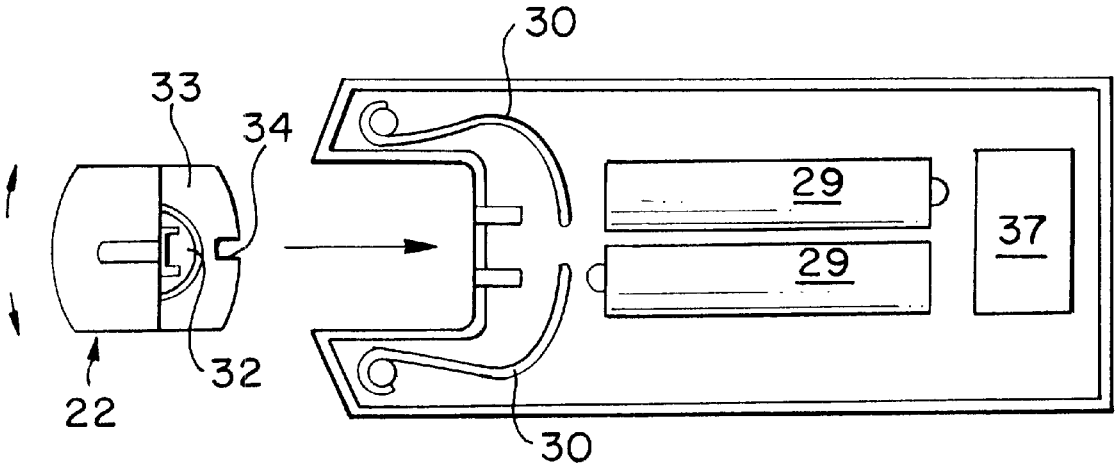
FIG. 4 is a disassembled view of the flashlight housing of the invention, helpful in an understanding of its illuminating operations.

FIG. 4 schematically illustrates, in partial form, the inside of the flashlight housing 16 indicating the operation of the "on-off" switch of the front end 22 of FIGS. 2*a*–2*c*—, and of a size to accommodate, for example, a pair of AA alkaline batteries 29. A pair of metallic leaf springs 30 couple to the "+" and "−" electrodes of the batteries 29 in series connection, with the circuit being completed by a pair of metallic contact springs 32 at either opposite side 33 of the rotatable front end switch. By offsetting the springs 32 to one side of the centering fulcrum 34, and by fabricating the metallic leaf springs 30 to be resilient, the sides 33 and the front end switch are held in position, such that rotation of the front end 22 from the quiescent position of FIG. 2*a* brings the side springs 32 into contact with the leaf springs 30 in completing the electrical circuit, while rotation in the opposite direction, i.e. back toward FIG. 2*b*, breaks the circuit. Where rechargeable batteries are intended for employment as the power source—either for the steady light beam through the front end 22 of the housing 16, or through its back end 26, appropriate prongs could be incorporated—in any known manner—on the outside of the housing 16, to fit within an optional charging unit for the flashlight. Reference numeral 37, on the other hand, shows an alkaline battery source (where one is used), for the rearward, flashing warning light protector of the invention.

While there have been described what are considered to be preferred embodiments of the present invention, it will be readily appreciated by those skilled in the art that modifications can be made without departing from the scope of the teachings herein. As will also be understandable, while the invention has been described in the context of use by law enforcement personnel, the teachings would apply equally as well to flashlights of the type as employed, for example, by emergency medical service technicians—who likewise will be seen to benefit from the use of a flashlight secured at a shoulder area in permitting unfettered use of the hands in dealing with an injured person—freed from the necessity of having to hold a flashlight in an awkward position under and at an armpit location—while a flashing light continues to provide a type of warning beacon alerting as to their ongoing presence at an accident scene. For at least such reason, therefore, resort should be had to the claims appended hereto for a true understanding of the scope of the invention.

We claim:

1. The combination comprising:

a flashlight in a housing of given size dimension, and with said housing having a fastener at a top surface thereof; and a shoulder epaulet on an article of clothing;

with said flashlight being selected of size dimension to fit said flashlight within said epaulet when said article of clothing is worn, and with said fastener of said housing then being secured to said epaulet.

2. The combination of claim 1 wherein said flashlight includes a front end rotatable from an initial quiescent position to turn "on" the light beam generated by said flashlight, and wherein rotation of said front end back to said initial quiescent position turns said light beam "off".

3. The combination of claim 2 wherein said front end of said flashlight faces inwardly thereof when rotated to said initial quiescent position.

4. The combination of claim 2 wherein said flashlight includes a front end rotatable upwards and downwards from said initial quiescent position to adjust the angle of said light beam generated by said flashlight.

5. The combination of claim 4 wherein said flashlight includes a rounded front end for spreading the light beam generated by said flashlight.

6. The combination of claim 2 wherein said flashlight includes a first source of illumination for generating said light beam to illuminate through said front end of said flashlight, and also includes a second source of illumination for generating a second light beam to illuminate through a back end of said flashlight.

7. The combination of claim 6 wherein said first source of illumination provides a steady light beam in use, and wherein said second source of illumination provides a flashing light beam in use.

8. The combination of claim 7 wherein said flashlight includes separate on-off controls for each of said first and second sources of light beam illumination.

9. The combination of claim 7 wherein at least one of said sources of light beam illumination is powered by a rechargeable battery included within said flashlight.

10. The combination of claim 1 wherein said flashlight housing is of rectangular cross-section of a width and thickness to fit under said shoulder epaulet.

11. The combination of claim 10 wherein said flashlight housing is of a width of the order of 1½ in. and of a thickness of the order of ¾ in.

12. The combination of claim 11 wherein said shoulder epaulet is included on an article of clothing as worn by a person engaged in law enforcement or emergency medical service activity.

13. The combination of claim 1 wherein said flashlight housing is selected of a size dimension to snugly fit within and under said shoulder epaulet, and wherein said fastener includes a clip to secure to said epaulet.

* * * * *